United States Patent [19]

Anderson et al.

[11] Patent Number: 4,776,455

[45] Date of Patent: Oct. 11, 1988

[54] COMPARTMENTED PRODUCT FOR DISPENSING TREATMENT AGENTS IN A WASHING OR DISHWASHING MACHINE

[75] Inventors: Stephen Anderson; John Lloyd; Geoffrey Newbold, all of Wirral; Douglas Wraige, Chester, all of England; Kumar Sunil, New Delhi, India

[73] Assignee: Lever Brothers Company, New York, N.Y.

[21] Appl. No.: 22,703

[22] Filed: Mar. 6, 1987

[30] Foreign Application Priority Data

Mar. 7, 1986 [GB] United Kingdom ..... 8605734

[51] Int. Cl.[4] ..... C11D 17/04

[52] U.S. Cl. ..... 206/0.5; 206/219; 252/92; 383/38; 383/116

[58] Field of Search ..... 206/0.5, 205, 219, 222; 252/90–93, 95, 99, 8.6, 8.8; 383/38–40, 100, 102, 103, 116

[56] References Cited

U.S. PATENT DOCUMENTS

| | | | |
|---|---|---|---|
| 1,854,235 | 4/1932 | Stoddard | 252/93 |
| 2,377,118 | 5/1945 | Weisman | 206/0.5 |
| 3,186,869 | 6/1965 | Friedman | 206/0.5 |
| 3,391,047 | 7/1968 | Kopp | 206/219 X |
| 4,000,996 | 1/1977 | Jordan | 206/219 X |
| 4,113,630 | 9/1978 | Hagner et al. | 252/8.6 |
| 4,139,475 | 2/1979 | Schwadtke et al. | 252/8.6 |
| 4,188,304 | 2/1980 | Clarke et al. | 252/93 |
| 4,215,508 | 8/1980 | Allen et al. | 206/0.5 X |
| 4,259,373 | 3/1981 | Demessemackers et al. | 206/0.5 X |
| 4,410,441 | 10/1983 | Davies et al. | 206/0.5 |
| 4,515,703 | 5/1985 | Haq | 252/92 |
| 4,588,080 | 5/1986 | Ginn | 206/219 |
| 4,622,161 | 11/1986 | Cornelissens et al. | 252/90 |

FOREIGN PATENT DOCUMENTS

| | | |
|---|---|---|
| 18678 | 11/1980 | European Pat. Off. . |
| 66463 | 12/1982 | European Pat. Off. . |
| 90311 | 10/1983 | European Pat. Off. . |
| 132726 | 2/1985 | European Pat. Off. . |
| 143476 | 6/1985 | European Pat. Off. . |
| 2000177 | 1/1979 | United Kingdom . |

*Primary Examiner*—Stephen Marcus
*Assistant Examiner*—Bryon Gehman
*Attorney, Agent, or Firm*—Milton L. Honig; James J. Farrell

[57] ABSTRACT

A multicompartment sachet product for delivering treatment agents to the washing machine or dishwasher comprises a first compartment capable of releasing its contents (solid or liquid) within 3 minutes from the start of the wash process, and a second compartment of water-permeable material provided with a pore-occluding coating and/or in the form of a sachet within a sachet so that release of its contents (powder) is delayed for at least 5 minutes from the restart of the wash process and/or retarded.

8 Claims, 4 Drawing Sheets

COMPARTMENTED PRODUCT FOR DISPENSING TREATMENT AGENTS IN A WASHING OR DISHWASHING MACHINE

TECHNICAL FIELD OF THE INVENTION

The present invention relates to a product in the form of a multicompartment sachet for the delivery of treatment agents, for example, detergent, bleach, enzyme, rinse conditioner or rinse aid, into the wash liquor in an automatic washing machine or dishwasher.

BACKGROUND AND PRIOR ART

Multicompartment sachets for delivering ingredients in washing machines in a sequential manner have been disclosed in the prior art.

GB No. 2 000 177B (Akzo) discloses a two-compartment sachet containing a phosphate free detergent composition based on sodium carbonate. A first compartment is bounded by a water-permeable wall and separated by a partition from a second compartment bounded by an impermeable wall; the partition wall is of material that disintegrates in the wash water. The contents of the second compartment are therefore not released until the contents of the first compartment have been leached out and the partition wall has disintegrated.

U.S. Pat. No. 4,410,441 (Davies et al/Lever Brothers Company) discloses another two-compartment sachet which differs from that of GB No. 2 000 177B in that the partition wall is of water-insoluble water-permeable material. Release of the contents of the second compartment is by leaching out through the porous partition after the contents of the first compartment have been delivered.

EP No. 143 476A (Akzo) discloses a sachet having two compartments, one being formed of water-permeable material or material that immediately disintegrates in water and the other being formed of water-impermeable non-disintegrating material and being sealed with a water-sensitive composition comprising an anionic and/or nonionic water-binding polymer, for example, polyvinyl pyrrolidone and a cationic polymeric adhesive, for example, polyethyleneimine. The first compartment releases its contents rapidly, while release from the second compartment is delayed by the slow opening of the water-sensitive seals.

EP No. 66 463B (Unilever) discloses an article for releasing an active material in a controlled manner, comprising two layers of sheet material (laminates each consisting of an outer porous layer and an inner plastics film layer) bonded together in a grid pattern to form an array of cells or compartments. The sheet material is pinholed for release of active material. If desired different compartments can contain different active material and can be pinholed to differing extents to allow release of different active material at different rates.

SUMMARY OF THE INVENTION

The present invention provides a product for the delivery of treatment agents into the wash liquor of an automatic washing or dishwashing machine, comprising a sachet having at least two compartments, including:

(i) a first compartment of water-insoluble material containing a first treatment agent, said first compartment having at least one opening seal and/or being formed of porous water-permeable material, and being capable of releasing said first treatment agent into the wash liquor of a washing or dishwashing machine within a period of 3 minutes from the start of the wash process; and (ii) a second, non-opening, compartment containing a second, water-soluble or water-dispersible, treatment agent in particulate form, said second compartment being formed at least partially of porous water-permeable material through which said second treatment agent can be leached out by the wash liquor, said second compartment being provided with means for delaying said leaching out for at least 5 minutes from the start of the wash process and/or for retarding said leaching out, said delaying and/or retarding means comprising (a) a substantially wholly pore-occluding external coating or layer that is capable of being disrupted by the wash liquor, and/or (b) the enclosure of the second compartment within another sachet compartment of porous water-permeable material.

DETAILED DESCRIPTION OF THE INVENTION

The sachet of the invention contains at least two different compartments and is designed to deliver their contents in distinctly different ways: the contents of the first compartment are released very rapidly while the release of the contents of the second compartment is delayed and/or retarded.

In a preferred embodiment of the invention, the sachet s designed to deliver its contents in at least two discrete stages, with an interval between the deliveries of at least 2 minutes, preferably at least 5 minutes and advantageously from 10 to 15 minutes, from at least two different compartments. The contents of the compartments may if desired be identical, but the sachet of the invention is especially useful for delivering different ingredients at different stages in the washing or dishwashing process.

The contents of the second compartment are in pulverulent or granular form while the contents of the first compartment can be in any desired form compatible with the nature of the compartment's walls and seals. Any compositions that can be used to treat laundry or a dishwasher load may be delivered by means of the sachet of the invention provided that the second treatment agent is water-soluble or water-dispersible. Examples include detergents, bleaches, rinse conditioners, enzymes, deodorants and rinse aids. In fabric washing, for example, a detergent composition may be delivered from the first compartment and a bleach or rinse conditioner frm the second; such a product may be a self-contained whole wash product. An additive product intended to boost the performance of a conventional detergent powder may, for example, deliver an enzyme from the first compartment and a bleach from the second. A product for dishwasher use may, for example, deliver a cleaning composition with enzyme from the first compartment and a chlorine bleach from the second. These are only examples, and the skilled worker will readily be able to think of other combinations where segregation combined with delayed or retarded release of certain components is advantageous or even essential.

In the present specification the terms "wash liquor", "wash process" and "wash environment" should be understood to apply both to fabric washing machines and to dishwashing machines. The expression "start of the wash process" will also be used, and this should be understood as the time at which the water fill is substantially complete and full agitation commences; any period of static heat-up and any short bursts of agitation before water fill is complete are regarded as occurring before the start of the wash process.

In principle the sachet of the invention may have any number of compartments greater than one, but for simplicity the preferred embodiment of a two-compartment sachet will now be discussed.

The first compartment is so designed that its contents will be released at or very shortly after the beginning of the wash cycle in the washing or dishwashing machine. Substantially complete delivery of the contents of the first compartment occurs within at least 3 minutes of the start of the wash process, and preferably within 1 minute. The first compartment must therefore combine the ability to contain a composition securely in the dry state with the ability to release that composition quickly when exposed to water, or water and agitation, in the wash environment.

The first compartment may be provided with one or more seals that open when the sachet is exposed to the wash environment, for example, seals sensitive to water, temperature or agitation. A water-sensitive adhesive as described in GB No. 1 583 082 (Unilever) may be used; or a mechanically weak heat-seal as described in EP No. 11 500B (Unilever). An example of a suitable water-sensitive adhesive is sodium carboxymethylcellulose.

When the contents of the first compartment are liquid, it may suitably be provided with one or more mechanically weak heat-seals, as described in EP No. 40 931B (Unilever), that will open as a result of agitation in the wash environment.

If the first compartment is of the opening type and its contents are in powder form, it may be made of either water-permeable or water-impermeable material. Suitable materials include wet-strength paper; woven; knitted or nonwoven fabrics; and plastics films. A material that has been found to be highly suitable is tea bag paper manufactured by Crompton Ltd., UK. The impermeable materials mentioned are also suitable for containing liquids.

It is also possible for the first compartment, if its contents are in powder form, to be of a non-opening type, in which case its walls must be made of highly water-permeable material. The pore size of the wall material must be sufficiently large to allow very rapid leaching out of the contents of the compartment, but it may be necessary to prevent leakage of the contents in the dry state, for example, by ensuring that the composition contained in the compartment is free of particles smaller than the pore size of the wall material, or by coating the outside of the compartment walls with a pore-occluding coating or layer of material that will be disrupted (dissolved or dispersed) very rapidly by the wash liquor.

The second compartment, in contrast to the first, is so designed that its contents, which are in powder form, will be released only gradually and/or after a delay of at least 5 minutes. Preferably release, whether gradual or not, occurs only after a delay of at least 5 minutes, preferably at least 10 minutes: the delay required will depend on the intended use of the sachet of the invention and the machine cycle that it has to match, delays of from 5 to 90 minutes typically being useful. The second compartment is of the non-opening type, and therefore it has at least one wall of porous water-permeable material. Release from the second compartment is by leaching out of its contents by the wash liquor through its porous water-permeable wall(s), and this process is delayed and/or retarded by means of one or both of two measures. The first of these is the provision of a pore-occluding coating or layer of a material that is disrupted (dissolved or dispersed) by the wash liquor; unlike the coating mentioned above for the first compartment, this should be of a material that is not too soluble or dispersible, so that its disruption occurs over a sufficiently long period to provide some delay and/or retardation.

Thus the sachet product of the invention may comprise a first compartment, and an adjacent second compartment separated from the first by a non-opening seam or a non-water-permeable partition wall, the second compartment being provided with a pore-occluding coating or layer.

Alternatively or additionalyy, the sachet can be enclosed within another sachet compartment of porous water-permeable material. This other sachet compartment may simply be the first compartment; the second compartment (inner sachet) is then located, together with the first treatment agent, in the first compartment (outer sachet). In this case, the first compartment (outer sachet) should be of the non-opening type to prevent escape of the inner sachet into the wash liquor, if the inner sachet does not have a pore-occluding coating or layer.

The inner sachet may be wholly separate from the outer sachet, or it may be attached; an integral construction created by folding is also possible. According to yet another possibility, the second compartment (inner sachet) may be located in a separate additional (third) compartment separated from the first compartment by a non-opening seam or a partition wall which is preferably water-impermeable.

The inner sachet may conveniently be made from a water-impermeable, thermoplastic sheet material, such as polyethylene film, provided with pin-holes. This form of construction is preferred as the inner sachet is readily heat-sealable. Additionally, by varying the number and size of the pin-holes the delay in release of the second treatment agent may be varied. Rapid release may be achieved by the provision of a large number of large diameter holes whereas slower release can be obtained from sachets having a small number of smaller diameter holes. Sachets for use in a conventional sized machine are preferably provided with a total of 2 to 8 pin-holes having a diameter of 0.5 to 1 mm. Reproducibility of release profiles is generally increased by provision of a large number of small holes and also by the provision of pin-holes in both faces of the sachet. Reproducibility is also increased in general when the pin-holes are comparatively close to the sachet corners.

In embodiments where the first and second compartments have a porous wall in common, there is a danger of premature mixing in the dry state when the sachets are transported, stored and handled. The use of a pore-occluding coating or layer for the second compartment is then particularly beneficial. When no such coating or layer is to be used, designs in which the two compartments are separated by a water-impermeable partition or by a non-opening seam are preferred.

If the second compartment is integral with the first it is most conveniently made of the same material, which will of course have the same porosity. This is, however, not essential. If the first compartment is of the opening type, the porosity of that material can be relatively low, and a coating to reduce the porosity of the second compartment may be unnecessary. If the first compartment is non-opening and of relatively high porosity, a coating will probably be needed for the second compartment and a different (more quickly disrupted) coating may also be needed for the first compartment.

If the second compartment is a separate inner sachet, it may of course be made of a different material from that of the first compartment and the porosity of both compartments can then be chosen at will.

Examples of suitable pore-occluding coating materials include fatty acids, for example, stearic acid, which disperse slowly; polyethylene glycols, which can disperse quickly or slowly depending on molecular weight; mixtures of fatty acids and polyethylene glycol, which can be tailored by suitable choice of proportions to give any chosen release rate; and long-chain nonionic surfactants, for example, tallow alcohol ethoxylates. A separate discrete layer of pore-occluding material, for example, polyvinyl alcohol film, may instead be laminated onto the porous wall material.

The pore-occluding material is preferably coated onto the sachet material at a level of 50 to 300 g/m$^2$, more preferably 150 to 250 g/m$^2$. The release rate is conveniently tailored by using a mixture of materials. For example, a 80:20 mixture of tallow 18EO and stearic acid will give a much greater release rate than a 20:80 mixture of the same components. In general, the rate of release is enchanced by the use of a high propertion of a material which is dispersed quickly in the wash liquor and depressed by the use of a materia which is dispersed slowly. The skilled worker will be able to determine suitable proportions by simple experimentation.

BRIEF DESCRIPTION OF DRAWINGS

Embodiments of the invention will now be described, by way of example only, with reference to the accompanying drawings in which.

DETAILED DESCRIPTION

Figure 1:
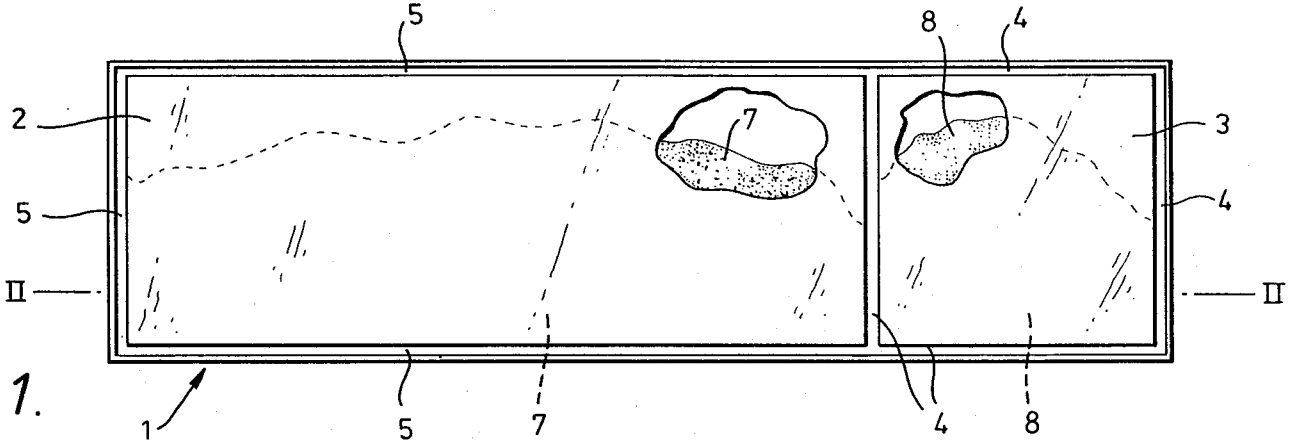
FIG. 1 is a plan view of a first sachet in accordance with the invention.

Referring now to FIG. 1 of the accompanying drawings, a two-compartment sachet 1 has a large first compartment 2 and a smaller second compartment 3. The sachet is made, for example, of Crompton (Trade Mark) tea bag paper, a cellulosic material which contains thermoplastic (polypropylene) fibres to render it heat-sealable. The second compartment 3 is bounded by strong heat-seals 4 that will not open in the wash liquor, while the remaining three edge seals 5 of the first compartment 2 are formed by a water-soluble adhesive, for example, sodium carboxymethylcellulose.

Figure 2:
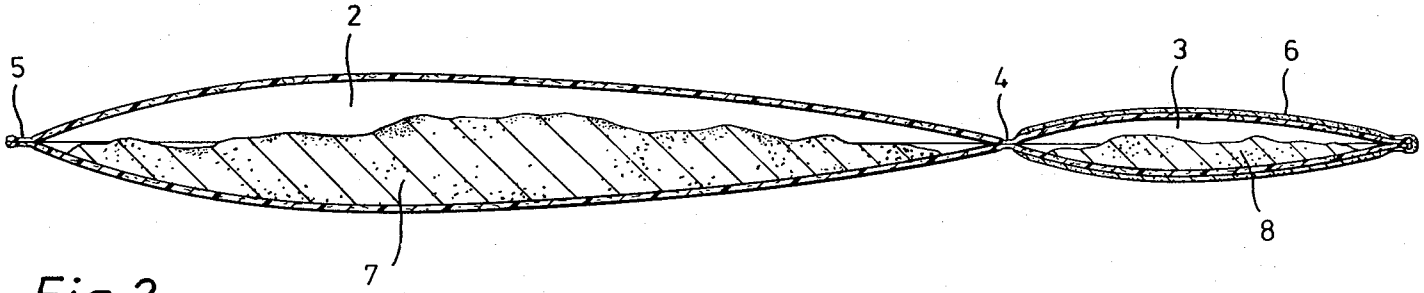
FIG. 2 is a section, on a larger scale, along the line II—II of FIG. 1.

Referring now to FIG. 2, the second compartment 3 is coated externally with a coating or layer 6 of pore-occluding material, for example, tallow alcohol 18 EO. The first compartment 2 contains a first powdered composition 7, for example, a detergent powder with enzyme, and the second compartment 3 contains a second powdered composition 8, for example, a bleach. In use, the sachet is placed together with the load in a washing or dishwashing machine. The first compartment opens very rapidly along the edges 5 and releases its contents within 1 to 3 minutes. The coating 6 on the second compartment is gradually dissolved and after a delay of about 5–15 minutes the walls of the compartment 3 are sufficiently exposed for its contents 8 to be leached out by the wash liquor.

Figure 3:
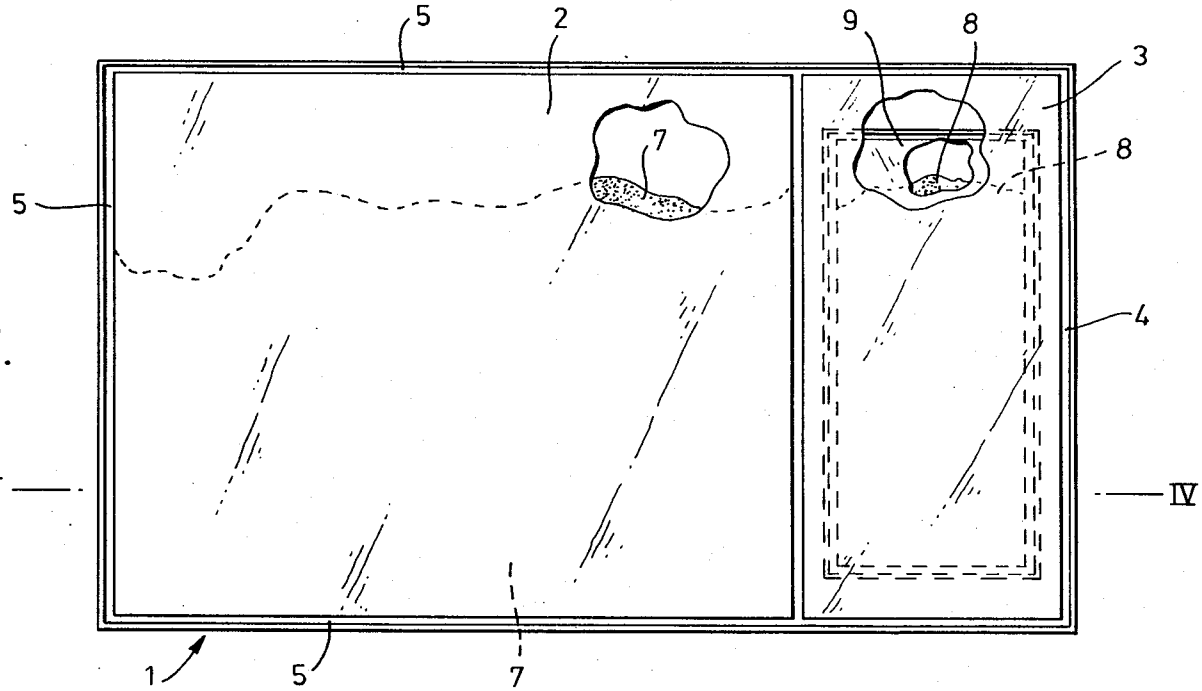
FIG. 3 is a plan view of a second sachet in accordance with the invention.
Figure 4:
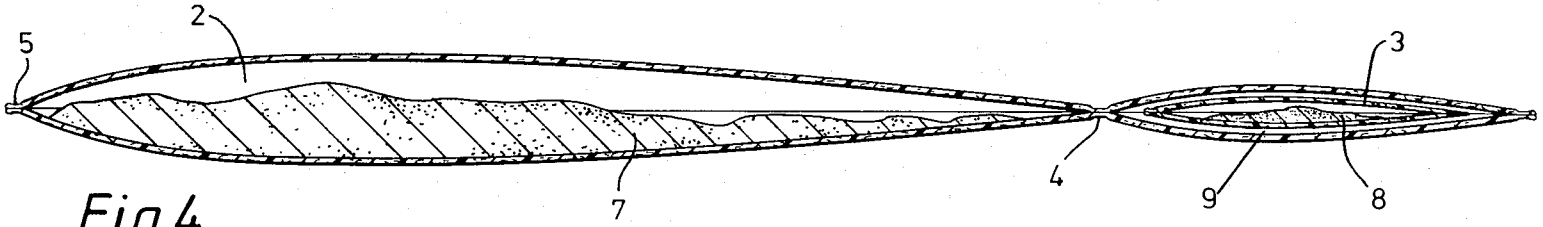
FIG. 4 is a section, on a larger scale, along the line IV—IV of FIG. 3.

FIG. 3 and 4 of the accompanying drawings show a sachet of slightly different construction. The second compartment 3 takes the form of an inner sachet within a third compartment 9. The inner sachet 3 may be of the same or a different material to that of the main sachet 1.

Figure 5:
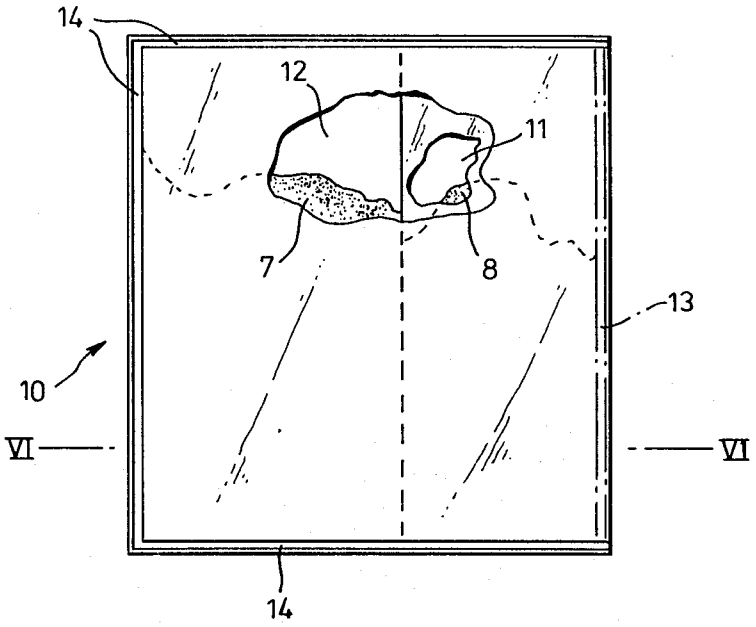
FIG. 5 is a plan view of a third sachet in accordance with the invention.
Figure 6:
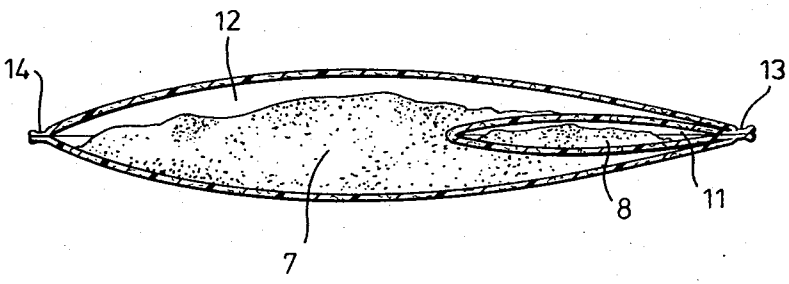
FIG. 6 is a section, on a larger scale, along the line VI—VI of FIG. 5.

A different sachet construction is shown in FIGS. 5 and 6 of the accompanying drawings. This sachet 10 is produced from a single sheet of porous water-impermeable material, for example, the polypropylene nonwoven fabric Kimtex (Trade Mark) ex Kimberly-Clark. The sheet is folded so as to generate a small inner compartment 11 (the second compartment) within a principal compartment 12 (the first compartment), and closed by heat-sealing along the folded edge 13 and along the other three edges 14: the edge seals 14 may be opening or non-opening. If desired the external surfaces of the walls of the inner compartment 11 could be coated or laminated with a pore-occluding material, but it is possible to obtain suitable delivery characteristics without using such a coating or layer if a sheet material of appropriate porosity is chosen. Alternatively, by using a sheet made of a mixture of materials joined for example by glueing or welding, the first compartment may be made of material different from the second.

As in the other embodiments the base weight of the sheet material is not critical, preferably it is in the range 15 to 150 g/m$^2$. If the material has a very high base weight some difficulty may be experienced in heat sealing the sachet as in some parts the construction is four layers thick, but the problem may be overcome by glueing.

Figure 7:
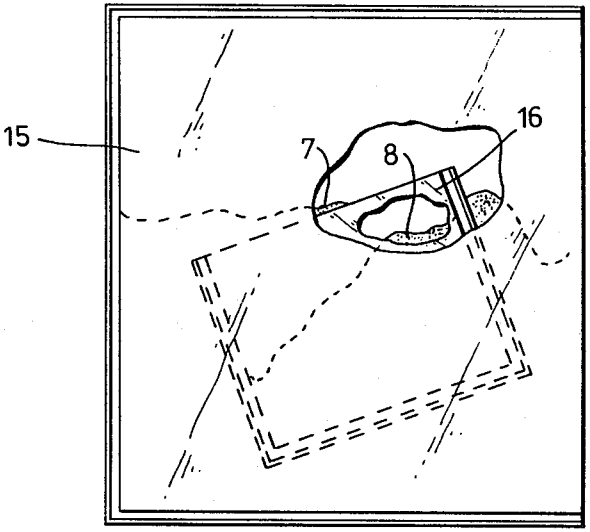
FIG. 7 is a plan view of a fourth sachet in accordance with the invention.
Figure 8:
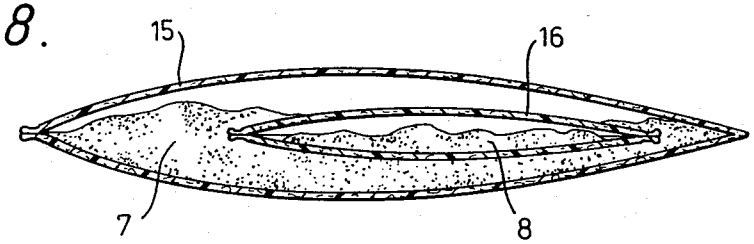
FIG. 8 is a schematic sectional view, on a larger scale, of a sachet as shown in FIG. 7.

Yet another sachet design is shown in FIGS. 7 and 8 of the accompanying drawings. An outer sachet 15 (the first compartment) of porous water-permeable sheet material contains the first powdered composition 7 for rapid delivery to the wash liquor and also contains an inner sachet 16 (the second compartment), also of water-permeable sheet material, containing the second powdered composition 8. As shown the inner sachet 16 is loose within the outer sachet 15, but if desired its position could be fixed, for example, by means of an edge seal common to both sachets. If desired, the inner sachet 16 may be provided with a pore-occluding outer coating or layer, but as with the embodiment of FIGS. 5 and 6 this may not be necessary if the porosities of the materials of the sachets (which may of course be different) are suitably chosen.

In any of the embodiments described above, the sachet product of the invention may be of such a size than a single unit will deliver an appropriate quantity of ingredients for a single washload. Greater flexibility for the consumer is, however, achieved if smaller units are produced in groups, for example, of two to six units, readily separable by tearing along perforated marginal regions.

EXAMPLE 1

An experiment was carried out to determine the release times of the two compartments of the sachet described above with reference to FIGS. 3 and 4 of the accompanying drawings. The main sachet 1 was made of Crompton (Trade Mark) 784 tea bag paper ex Crompton, and had overall dimensions of 15 cm×15 cm. The first compartment contained 110.6 g of non-bleaching detergent powder, including 3.6 g of sodium bromide, and was sealed with detergent-grade sodium carboxymethylcellulose. The inner sachet 3, of Kimtex (Trade Mark) polypropylene nonwoven fabric ex Kimberly-Clark, had dimensions of 13 cm×5 cm and contained 18 g of potassium peroxomonosulphate triple salt ex Interox. The inner sachet 3 had an outer coating of 200 g/m$^2$ (2.6 g in total) of tallow alcohol 18 EO (Lutensol (Trade Mark) AP 18 ex BASF).

Nine washing machine experiments were carried out to determine the time taken for the inner sachet 3 to release its contents. A Miele (Trade Mark) De Luxe Electronic 756 washing machine set to the 40° C. economy programme was used, with a mixed load of 2.5 kg of clean cotton and synthetic fabrics.

In each run the detergent powder was completely delivered from the first compartment within a period of 30 seconds to 1 minute from the start of the wash process. Delivery of substantially all of the bleaching agent from the second compartment took place in each run after a delay of 5 to 10 minutes, as can be seen from the Table below. This period can be lengthened or shortened by varying the type and level of coating on the inner sachet

| | 9. Bleach released | | | | | |
|---|---|---|---|---|---|---|
| | Time (Mins) | | | | | |
| (grams) | 1 | 3 | 5 | 7 | 10 | 15 |
| Run 1 | 0 | 0 | 1.4 | 15.6 | 18.0 | — |
| Run 2 | 0 | 0.2 | 2.1 | 18.0 | 18.0 | — |
| Run 3 | 0 | 0 | 4.0 | 12.8 | 18.0 | — |
| Run 4 | 0 | 0 | 3.6 | 18.0 | 18.0 | — |
| Run 5 | 0 | 0.4 | 1.7 | 18.0 | 18.0 | — |
| Run 6 | 0 | 0 | 0.9 | 15.4 | 18.0 | — |
| Run 7 | 0 | 0 | 0 | 2.4 | 15.6 | 18.0 |
| Run 8 | 0 | 0 | 0 | 3.4 | 17.1 | 18.0 |
| Run 9 | 0 | 0 | 0 | 2.1 | 13.0 | 18.0 |

EXAMPLE 2

A sachet of the type described by reference to FIGS. 7 and 8 was prepared as follows.

A rectangle of polyethylene film (6 cm by 3 cm) of 115 μm thickness was folded along the minor axis and heat-sealed along two edges. Calcium hypochlorite (1.25 g) was placed in the sachet which was then sealed along the open edge to give a square sachet having 3 cm sides. Three 1 mm holes were made in each face of the sachet.

A square sachet having 10 cm sides was made from a sheet of Sontara (Trade Mark) 8000 non-woven polyester sheet by folding a sheet of 10×20 cm material. Two sides were heat-sealed, and 25 g of conventional washing powder and the 3×3 cm sachet placed inside. The final seam was closed by heat-sealing. The complete sachet was placed in a Miele (Trade Mark) 429 washing machine along with a 2.5 kg ballast load of terry towelling and cotton sheeting. The machine was set into action to run a 30° C. cycle and the concentration of hypochlorite in the wash liquor measure at regular intervals. The following results were obtained:

| Time (mins) | Conc$^n$ of hypochlorite in wash liquor (ppm) |
|---|---|
| 5 | 0 |
| 10 | 0 |
| 15 | 23.9 |
| 20 | 81.6 |
| 25 | 97.6 |
| Rinse | |
| 1 | 29.3 |
| 2 | 14.2 |
| 3 | 12.3 |
| 4 | 0.9 |
| 5 | 0 |

The detergent was released within 3 minutes but release of the bleach was delayed for almost 15 minutes.

EXAMPLE 3

A sachet of the type described by reference to FIGS. 1 and 2 was prepared as follows: A strip of polyethylene laminated cellulosic non-woven fabric of base weight 30 g/m$^2$) (Storalene (Trade Mark)) of dimensions 30×5 cm was folded along the minor axis so that the polyethylene coated sides were adjacent to each other. The long seams were then heat-sealed. 25 g of conventional washing powder was introduced into the sachet which was then heat-sealed so that the powder was confined in a compartment of dimensions 15×5 cm defined in part by the folded seam. Calcium hypochlorite (1.25 g) was introduced into the open end of the sachet and the sachet sealed. Two pin-holes (1 mm diameter) were made in each face of the hypochlorite containing compartment, which compartment was then coated at 200 g/m$^2$ with a polyethylene glycol having an average molecular mass of 35,000.

The rate of release of the hypochlorite was measured in a similar experiment to that described in Example 2. The following results were obtained:

| Time (mins) | Conc$^n$ of hypochlorite in wash liquor (ppm) |
|---|---|
| 5 | 0 |
| 10 | 0 |
| 15 | 0 |
| 20 | 17.7 |
| 25 | 24.9 |
| 30 | 25.0 |

In this case no detectable amount of bleach was released for more than 15 minutes and the detergent composition was released within 3 minutes.

EXAMPLE 4

A piece of Kimtex (Trade Mark) melt blown polypropylene non-woven fabric of 70 g/m$^2$ and dimensions 15×27 cm was folded along the minor axis. Two further folds, equidistant (7.5 cm) from the first and parallel with it were then made so that the fabric adopted an 'M' shaped configuration. Three of the seams were then heat-sealed to give two open compartments, one of which was contained within the other. The inner compartment was filled with potassium monopersulphate (3 g) and the outer compartment was filled with a conventional detergent (20 g) and sodium bromide (0.6 g). The remaining seam was heat sealed with the rate of release of bleach into wash liquor determined as described in Examples 2 and 3. The following results were obtained:

| Time (mins) | Amount of bleach released (g) |
|---|---|
| 0.5 | 0 |
| 6.0 | 1 |
| 10 | 1.6 |
| 15 | 3.0 |
| 20 | 3.0 |

The delay of release was less than in the previous examples; about half the bleach was released with 10 minutes and all within 15 minutes. The detergent was released immediately.

We claim:

1. A product for the delivery of treatment agents into the wash liquor of an automatic washing or dishwashing machine, comprising a sachet having at least two compartments, including:

(i) a first compartment of water-insoluble material containing a first treatment agent, said first compartment having means for releasing said first treatment agent into the wash liquor of a washing or dishwashing machine within a period of 3 minutes from the start of a wash process, said means selected from the group consisting of, said first compartment having at least one opening seal, said first compartment being formed of porous water-permeable material, and a combination thereof; and (ii) a second, non-opening, compartment containing a second, water-soluble or water-dispersible, treatment agent in particulate form, said second compartment being formed at least partially of porous water-permeable material through which said second treatment agent can be leached out by the wash liquor, said second compartment being provided with means for retarding said leaching out retarding means selected from the group consisting of, (a) a substantially wholly pore-occluding external coating or layer that is capable of being disrupted by the wash liquor, and (b) an enclosure of the second compartment within another sachet compartment of porous water-permeable material.

2. A product as claimed in claim 1, wherein the second compartment is adjacent to the first compartment and separated therefrom by a non-opening seam, the walls of the second compartment being provided with a pore-occluding coating or layer.

3. A product as claimed in claim 1, wherein the second compartment is a separate sachet located within the first compartment.

4. A product according to claim 3, wherein the walls of the second compartment are provided with a pore-occluding coating or layer.

5. A product as claimed in claim 1, wherein the second compartment is integral with the first and located therein by means of folding.

6. A product according to claim 5, wherein the walls of the second compartment are provided with a pore-occluding coating or layer.

7. A product as claimed in claim 1, wherein the second compartment is a separate sachet located within a third compartment separated from the first compartment by a non-opening seam.

8. A product according to claim 7, wherein the walls of the second compartment are provided with a pore-occluding coating or layer.

* * * * *